US008578846B2

(12) United States Patent
Sherwood et al.

(10) Patent No.: US 8,578,846 B2
(45) Date of Patent: Nov. 12, 2013

(54) TRASH RECEPTACLE FOR COLLECTING AND COMPACTING WASTE AND RELATED METHOD OF USE

(75) Inventors: Christopher R. Sherwood, Park Ridge, NJ (US); Dale Walker, Palm Harbor, FL (US)

(73) Assignee: Got Green?, LLC, Bradenton, FL (US)

( * ) Notice: Subject to any disclaimer, the term of this patent is extended or adjusted under 35 U.S.C. 154(b) by 197 days.

(21) Appl. No.: 12/849,189

(22) Filed: Aug. 3, 2010

(65) Prior Publication Data

US 2011/0000382 A1 Jan. 6, 2011

Related U.S. Application Data

(63) Continuation-in-part of application No. 12/264,102, filed on Nov. 3, 2008, now Pat. No. 7,886,660.

(51) Int. Cl.
*B30B 13/00* (2006.01)

(52) U.S. Cl.
USPC ..... 100/35; 100/245

(58) Field of Classification Search
USPC ..... 100/35, 39, 98 R, 100, 215, 219, 229 R, 100/229 A, 233, 245, 255, 295
See application file for complete search history.

(56) References Cited

U.S. PATENT DOCUMENTS

| | | | | |
|---|---|---|---|---|
| 3,039,383 | A | 6/1962 | Windle et al. | |
| 3,104,607 | A * | 9/1963 | Galas | 100/345 |
| 3,625,140 | A | 12/1971 | Glanz | |
| 3,691,967 | A | 9/1972 | Mettetal, Jr. | |
| 3,955,492 | A | 5/1976 | Topolay | |
| 3,961,573 | A | 6/1976 | Schmidt | |
| 4,152,979 | A | 5/1979 | Schmidt | |
| 4,257,322 | A | 3/1981 | McDermott | |
| 4,290,352 | A | 9/1981 | Schmidt et al. | |
| 4,442,766 | A | 4/1984 | Hawkins | |
| 4,878,596 | A | 11/1989 | Cawley et al. | |
| 5,118,000 | A | 6/1992 | Howell et al. | |
| 5,203,669 | A | 4/1993 | Klossek et al. | |
| 5,465,914 | A | 11/1995 | Faccia | |
| 5,575,201 | A | 11/1996 | Fenner et al. | |
| 5,842,652 | A | 12/1998 | Warsing et al. | |
| 5,927,626 | A | 7/1999 | Shinjo et al. | |
| 6,158,336 | A | 12/2000 | Cambiano | |
| 6,247,662 | B1 | 6/2001 | Hamilton | |
| 6,505,550 | B2 | 1/2003 | Hamilton | |
| 6,543,343 | B2 | 4/2003 | Taylor | |
| 6,739,535 | B2 | 5/2004 | Labarbera | |
| 6,983,902 | B2 | 1/2006 | Faccia | |

(Continued)

*Primary Examiner* — Jimmy T Nguyen
(74) *Attorney, Agent, or Firm* — Carl M. Napolitano; Gray Robinson, P.A.

(57) ABSTRACT

The invention is directed to a trash receptacle which includes engaging members that communicate with a satellite vehicle to compact trash. Such trash receptacle comprises a rigid outer housing having four main panels (front panel, a back panel, a first side panel and a second side panel). The front panel includes passageways. The four panels form a basin. Positioned on the back panel via a hinge is a pivoting top door that attaches through a lock assembly. The pivoting top door further includes access doors. A compaction ram, having ram connectors that exit the various passageways of the front panel, is positioned between the first and second side panels. The compaction ram includes one or more track guides capable of resting within tracks located on the first side panel and second side panel of the rigid housing. Such compaction ram may include a plurality of triangular beams having sharp edges.

9 Claims, 14 Drawing Sheets

(56) References Cited

U.S. PATENT DOCUMENTS

| | | | | |
|---|---|---|---|---|
| 7,100,500 | B2 | 9/2006 | Soler | |
| 7,434,507 | B1 | 10/2008 | Sherwood | |
| 7,886,660 | B1 * | 2/2011 | Sherwood et al. | 100/229 A |
| 2004/0031403 | A1 | 2/2004 | Johnson | |
| 2007/0101875 | A1 | 5/2007 | Poss et al. | |

* cited by examiner

TRASH RECEPTACLE FOR COLLECTING AND COMPACTING WASTE AND RELATED METHOD OF USE

CROSS-REFERENCE TO RELATED APPLICATIONS

This application is a Continuation-in-Part of U.S. patent application Ser. No. 12/264,102 entitled "System and Trash Receptacle for Collecting and Compacting Trash," filed on Nov. 3, 2008, now U.S. Pat. No. 7,886,660, the contents of which are hereby incorporated by reference in its entirety.

FIELD OF THE INVENTION

This invention is directed to a trash receptacle for collecting and compacting trash. More specifically, the invention relates to a trash receptacle that includes a compaction ram sufficient to reduce the volume of garbage within a rigid outer housing so to decrease the number of times the trash receptacle must be emptied.

BACKGROUND OF THE INVENTION

Waste containers are devices for the temporary storage of waste which are usually manufactured of a metal, plastic or composite. Common terms used to identify waste containers include a rubbish bin, garbage can, trash can, dumpster, waste basket, or container bin. One prevalent form of waste container is the curbside dumpster (also known as a skip) which is a centralized receptacle used to collect and store large volumes of waste. These dumpsters are usually owned and operated by a municipality or a third-party waste vendor hired by a municipality. Regardless, these dumpsters are routinely emptied by large waste collection vehicles on a pre-set schedule.

Most often in commercial and residential community settings, a large dumpster is posited at strategic locations for individuals needing to deposit trash. One or more lids are typically placed on the top of each dumpster. Each of these lids pivot to open the dumpster to allow deposit of trash, for later scheduled collection by the large waste collection vehicle. Such lids function to prevent deposit of significantly large and bulky trash items which may degrade or puncture the dumpster.

The large waste collection vehicles visit the dumpsters during scheduled visits and engage each dumpster through use of forward extending forks designed to lift the dumpster and invert it over an opening within the collection vehicle to empty the dumpster and then replace it on the ground for continued use.

Trash collection services that include routine scheduled emptying of dumpsters constitutes a significant expenditure for commercial and residential facilities and is typically billed on a per visit basis. However, many times these trash dumpsters are less than full and the emptying schedule is excessive in that trash dumpsters could easily be filed with additional trash before emptying occurs.

Moreover, trash typically deposited in dumpsters is loose and expansive such that it takes up a significant volume, despite the fact the loose trash is mostly air. Thus, if such trash was somehow compacted to reduce its overall volume, the dumpster could easily handle increased loads and amounts of trash before the dumpster would require emptying by a large commercial vehicle.

Accordingly, there is a need in the art of trash receptacles for a robust dumpster design that allows for compaction between visits by large commercial vehicles. Such dumpster should be able to reduce the volume of loose trash in order to maximize use of the dumpster.

SUMMARY OF THE INVENTION

The instant invention solves many of the problems caused by current trash receptacle designs. More specifically, the invention relates to a trash receptacle which allows for collection and later compaction of waste through use of a satellite vehicle having a power unit—to reduce the number of visits by large commercial vehicles. This apparatus comprises a rigid outer housing having four main panels: a front panel, a back panel, a first side panel and a second side panel. The front panel may include one or more passageways.

The four panels of the rigid outer housing each may connect to form the bottom panel to form a basin, which may be water tight. The rigid outer housing is shaped such that the front panel slopes generally outward compared to the back panel, while the first side panel and second side panel are essentially parallel to one another. Positioned on the back panel via a hinge is a pivoting top door that attaches to the rigid outer housing through a lock assembly. The pivoting top door further includes a front side that has one or more access doors to allow placement of garbage. In addition one or more side doors may also (or alternatively) have a side access door. Moreover, the rigid outer housing may feature a deodorizer (which may have an antibacterial agent) to improve the smell of the trash receptacle.

A compaction ram (having one or more ram connectors, which may exit the various passageways of the front panel) may be positioned between the first side panel and second side panel. More specifically, the compaction ram may have a first edge and second edge where both edges include one or more track guides capable of resting within linear tracks located on the first side panel and second side panel of the rigid housing. Such compaction ram may also include a plurality of triangular beams such that each triangular beam includes a sharp edge.

The lock assembly may include a pivot shaft having a first end and corresponding second end. The first end of the pivot shaft is connected via a first pin to a rotatable swivel lock having a finger lock that forms a lock groove. Further, the second end of the pivot shaft may connect to a pivoting foot via a second pin. The finger lock is of a sufficient size and dimension so as to engage a lock pin positioned along the pivoting to door.

The trash receptacle system may also include a satellite vehicle having a power unit. Such power unit may include one or more connecting bars having a first end and corresponding second end. The first end of each connecting bar includes a perpendicular contact bar, while the second end of the connecting bar communicates with an actuator. Such actuator may be a pneumatic or hydraulically powered piston.

In addition, the power unit may include one or more engaging bars capable of affixing to one or more engaging members positioned on the first side panel and second side panel of the rigid outer housing. Each engaging bar may include a curved distal end having a knob protruding from its bottom side. This knob may have a sufficient size and dimension to fit and engage with a circular recess located on each engaging member.

The satellite vehicle may include a mounting plate having a vertical riser, a powered hinge and a horizontal housing assembly. The vertical riser functions to vertically move the housing assembly in relation to the height of the various ram connectors located within the compaction ram. The power unit may be integral with the satellite vehicle or alternatively may be a separate attachment.

The invention is further directed to a method of compacting trash through use of a trash receptacle. The first step of the method is to position one or more connecting bars of a power unit proximate one or more ram connectors positioned on a compaction ram located within a rigid outer housing. Such rigid outer housing includes a front panel, corresponding back panel, a first side panel and a corresponding second side panel. The front panel may include one or more passageways capable of allowing access to the one or more ram connectors.

The second step may include engaging the one or more connecting bars with one or more ram connectors through use of contact bars positioned at one end of each connecting bar. Upon engaging such connecting bars, the third step is to move the compaction ram toward the back panel of the rigid outer housing through one or more track guides in communication with one or more linear track guides positioned on the first side wall and second side wall of the rigid outer housing.

The fourth step of the method is to compact the trash positioned within the rigid outer housing through contact between the back panel and the compaction ram. Upon compaction, the fifth step is to return the compaction ram to a position proximate the first panel of the rigid outer housing through use of one or more actuators positioned between the connecting bars as the power unit. The final step is to disengage the one or more connecting bars with the one or more ram connectors and withdraw the satellite vehicle.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overall Trash Receptacle

Figure 1:
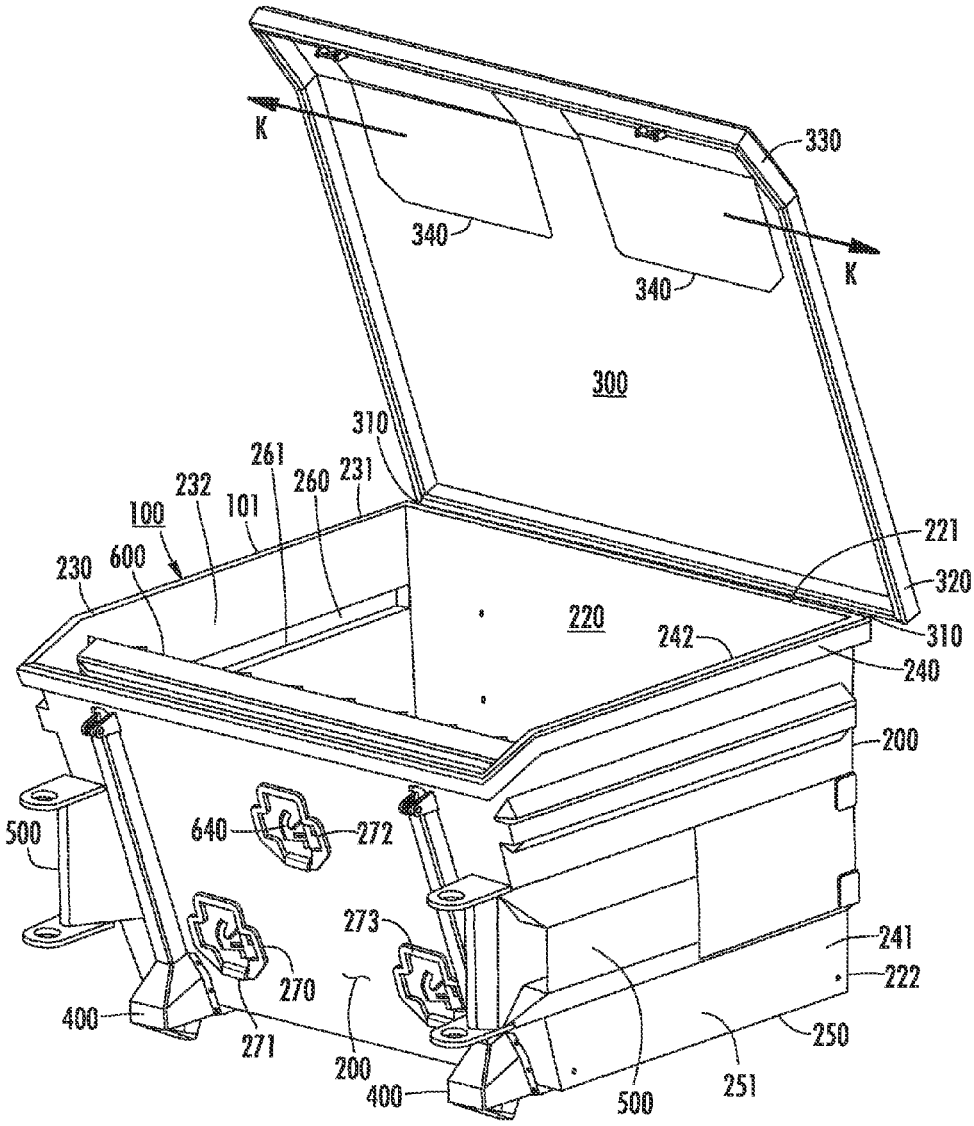
FIG. 1 is a perspective view of the trash receptacle including a pivoting top door.
Figure 2:
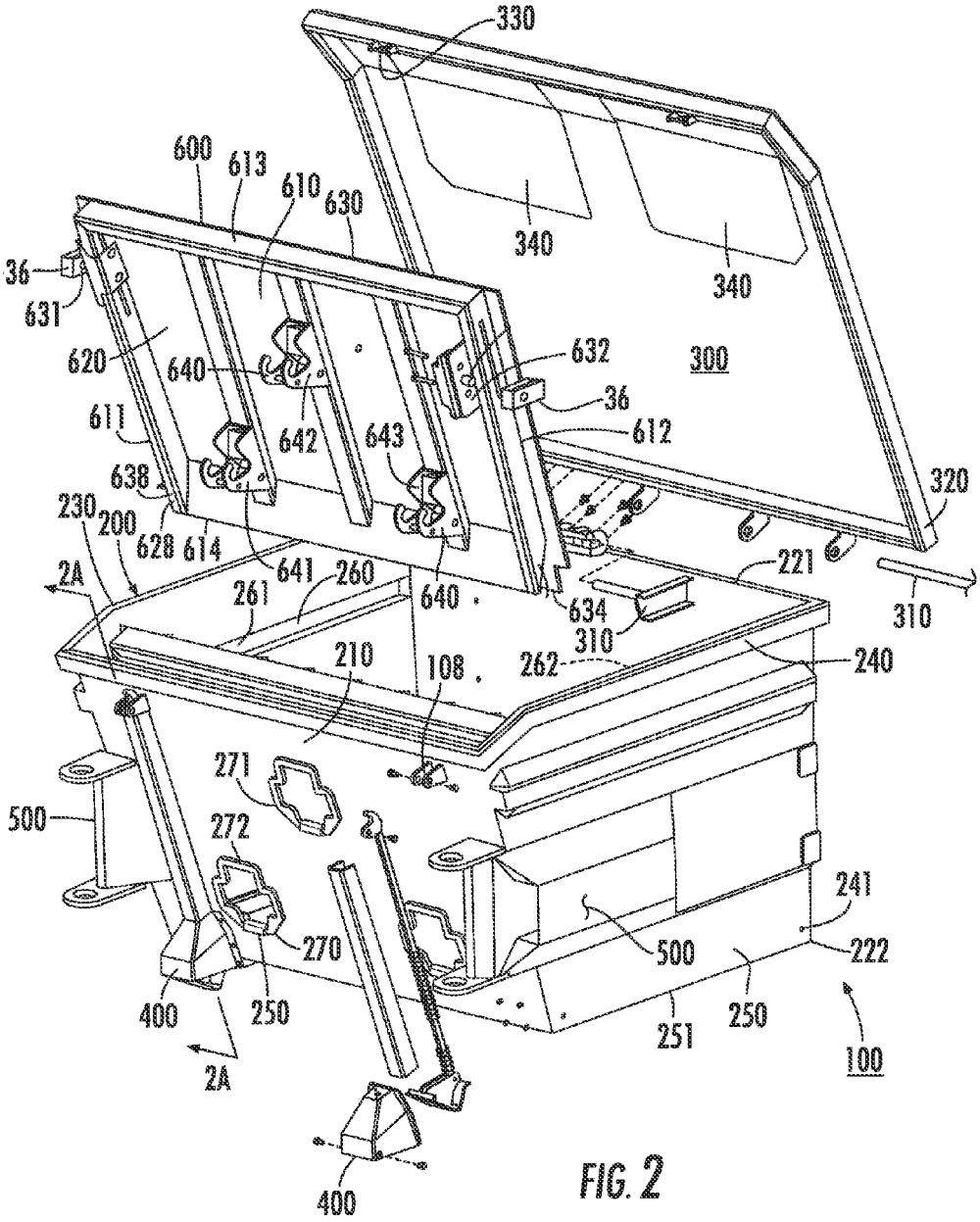
FIG. 2 is an exploded view of FIG. 1 showing the various components of the trash receptacle.

Both FIG. 1 and FIG. 2 illustrate, by way of example, one embodiment for the trash receptacle 100. First turning to FIG. 1, the trash receptacle 100 includes five primary components 101: a rigid outer housing 200, a pivoting top door 300, a corresponding lock assembly 400 (to open and lock the top door 300), a pair of engaging members 500 and a movable compaction ram 600 (positioned within the outer housing 200). Other additional components 101 will be recognized and understood by those of ordinary skill in the art upon review of the following disclosure and related figures.

As further shown in FIG. 1, the rigid outer housing 200 can include a front panel 210, a corresponding back panel 220, a first side panel 230 and corresponding second side panel 240. The first side panel 230 and the second side panel 240 are essentially in parallel relation to one another. The first side panel 230 includes an outer wall 231 and a corresponding interior wall 232. Correspondingly, the second side panel 240 includes an outer wall 241 and corresponding interior wall 242. As illustrated, the second side panel 240 mirrors the size, dimension and components of the first side panel 230.

The front panel 210 is configured to slope generally outward and forward and includes three spaced actuator openings 211-213. A bottom panel 250 is positioned perpendicular to the other four panels 210-240 sufficient to form a welded basin 251 that is essentially water tight. Each of the five panels 210-250 are essentially planar and constructed from a rigid, strong, and study material such as a metal, composite or plastic. More specifically, the outer rigid housing 200 is preferably made of steel or similar material known to those of ordinary skill in the art.

As further shown in FIG. 1, the back panel 220 includes a top side 221 and corresponding bottom side 222. Positioned on the top side 221 is a hinge bar 310 which connects to the back side 320 of the pivoting top door 300. Such pivoting top door 300 is capable of tipping up to 270 degrees. Positioned proximate the front side 330 of the pivoting door 300 are two access doors 340. Both access doors 340 allow placement of garbage within the trash receptacle 100, without the need to open the more heavy and bulky pivoting top door 300. Moreover, the size and dimension of both access doors 340 prevents large and bulky trash from entering the rigid outer housing 200 in order to prevent risk of degrading or damaging the basin 251. Such structure prevents large items such furniture and tires from being improperly disposed.

The Movable Compaction Ram

Next turning to FIG. 2, the trash receptacle 100 further includes a movable compaction ram 600. The movable compaction ram 600 is essentially a flat panel 610 which includes a first planar wall 620 and corresponding second wall 630. Moreover, the flat panel 610 also includes a first side 611, a corresponding second side 612, a top side 613 and corresponding bottom side 614. Such flat panel 610 is of a sufficient size and dimension to fit between the first side panel 230 and second side panel 240 of the rigid outer housing 200. Moreover, the compaction ram 600 is dimensioned so as to rest on the front panel 210 of the rigid outer housing 200 when in normal operation.

A plurality of ram connectors 640 are positioned on the front panel 210 of the compaction ram 600 to later engage and connect with a satellite vehicle 700 (shown in FIG. 8 and FIG. 9). Specifically, this can include a first ram connector 641, a second ram connector 642 and a corresponding third ram connector 643. These three ram connectors 640 are positioned along the front panel 210 so as to align with various passageways 270 positioned on the front panel 210 of the rigid outer housing 200. For example, the first ram connector 641 is accessible through a first passageway 271. Likewise, a second passageway 272 allows access to the second ram connector 642.

As is further shown in FIG. 2, the compaction ram 600 includes a series of track guides 36 (both top track guides and lower track guides) which rest within tracks 260 positioned within the rigid outer housing 200. These tracks 260 help move the compaction ram 600 to compress and reduce the volume of trash contained within the trash receptacle 100. More specifically, the first side 611 of the compaction ram 600 (proximate the top side 613) includes a first track guide 631. The first track guide 631 is of a sufficient size and dimension so as to engage a first track 261 (which can be in the form of a linear groove) positioned within the interior wall 232 of the first side panel 230.

Correspondingly, the second side 612 of the compaction ram 600 includes a second track guide 632. The second track guide 632 is of a sufficient size and dimension so as to engage a second track 262 (which can be in the form of a linear groove) positioned within the interior wall 242 of the second side panel 240. Both the first track 261 and corresponding second track 262 essentially mirror one another in length, dimension and orientation. Moreover, they essentially the same height along both side walls 230 and 240 of the rigid outer housing 200.

As further shown in FIG. 2, the compaction ram 600 can further include a set of track guides 36 positioned proximate the bottom side 614. More specifically, the first side 611 of the compaction ram 600 (proximate the bottom side 614) may include a third track guide 633. The third track guide 633 can engage a third track 263 (which can be in the form of a linear groove shown in FIG. 6A) positioned within the interior wall 232 of the first side panel 230. In addition, a second side 612 can include a fourth track guide 634 which engages a fourth track 264 located on the interior wall 242 of the second side panel 240. Preferably, the first track 261 and third track 263 are parallel to one another on the first side panel 230. Likewise, the second track 262 is parallel to the fourth track 264 on the second side panel 240.

Figure 3:
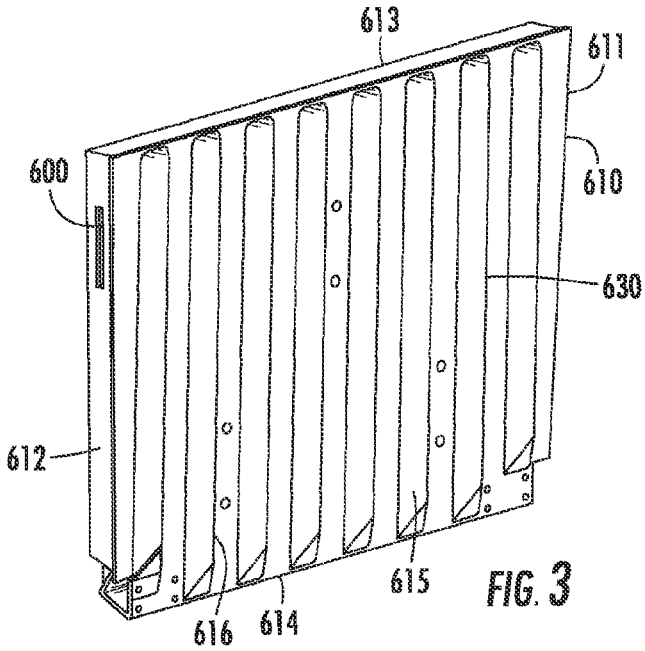
FIG. 3 is a perspective view of the shape and dimension of the movable compaction ram.

FIGS. 3 though 5 provide additional illustrations of the compaction ram 600. FIG. 3 illustrates the second side 612 of the flat panel 610. As shown, the second side 612 is preferably corrugated such that it includes a plurality of triangular beams 615. Each of these triangular beams 615 are parallel to one another and positioned vertically in relation to the flat panel 610. A similar view of the components and construction of the second side 612 of the flat panel is likewise shown in FIG. 7.

Figure 7:
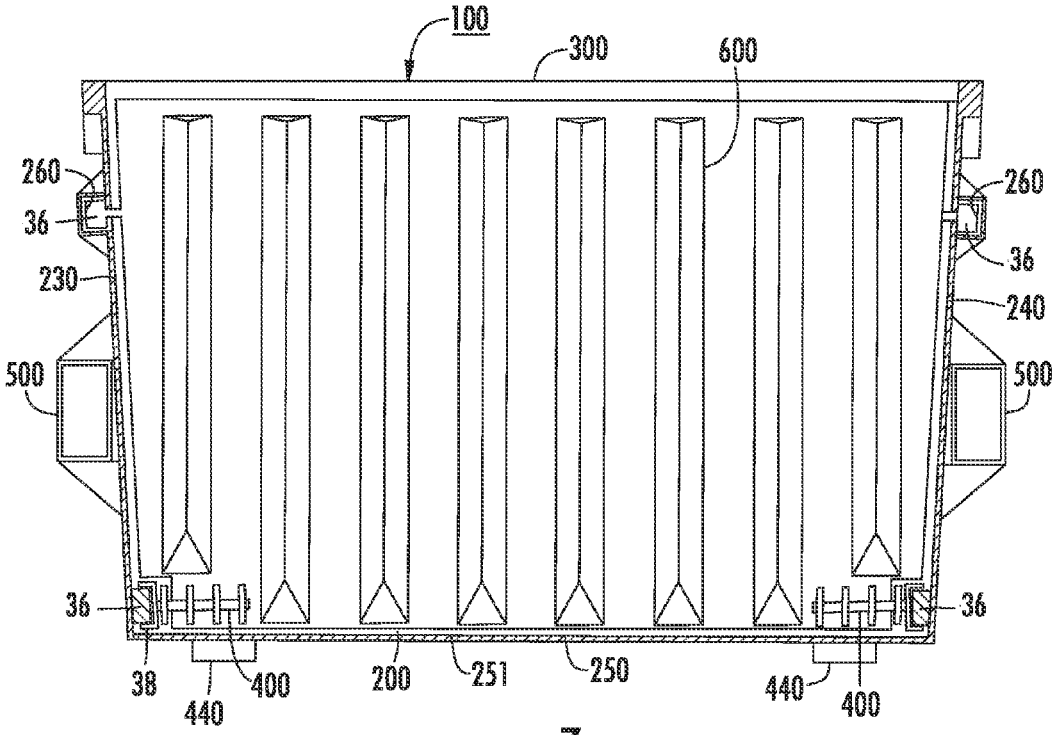
FIG. 7 is a cross sectional view of the trash receptacle showing the movable compaction ram.

There are three primary functions of these triangular beams 615 shown in FIG. 3 and FIG. 7. First, the triangular beams 615 help reinforce and provide rigidity to the compaction ram 600, which is crucial when compacting garbage within the trash receptacle 100. Second, the shape and configuration of each triangular beam 615 helps create a sharp edge 616 which is capable of engaging the trash/garbage when the compaction ram 600 is engaged. Put another way, the sharp edge 616 breaks up and separates the trash which aids compaction and efficiency of the overall trash receptacle 100. Third, the use of the triangular beams 615 help reduce the overall weight of the compaction ram 600, by allowing the underlying flat panel 610 to be relatively thin.

Figure 4:
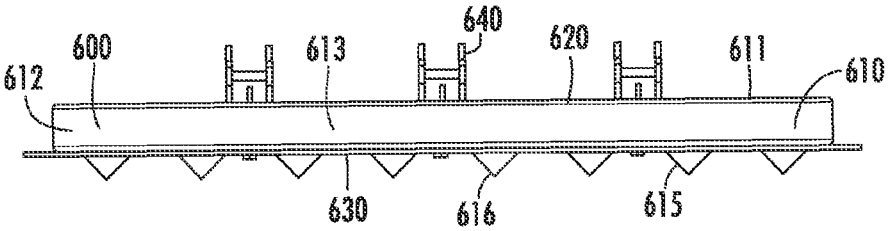
FIG. 4 is a top view of the movable compaction ram.
Figure 5:
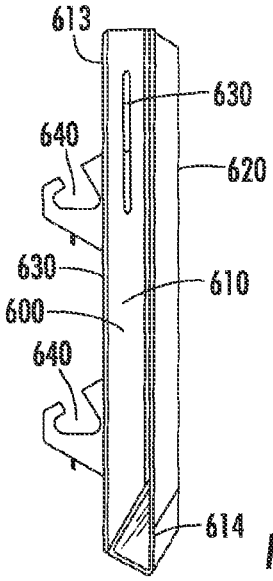
FIG. 5 is a left side view of the movable compaction ram.
Figure 11:
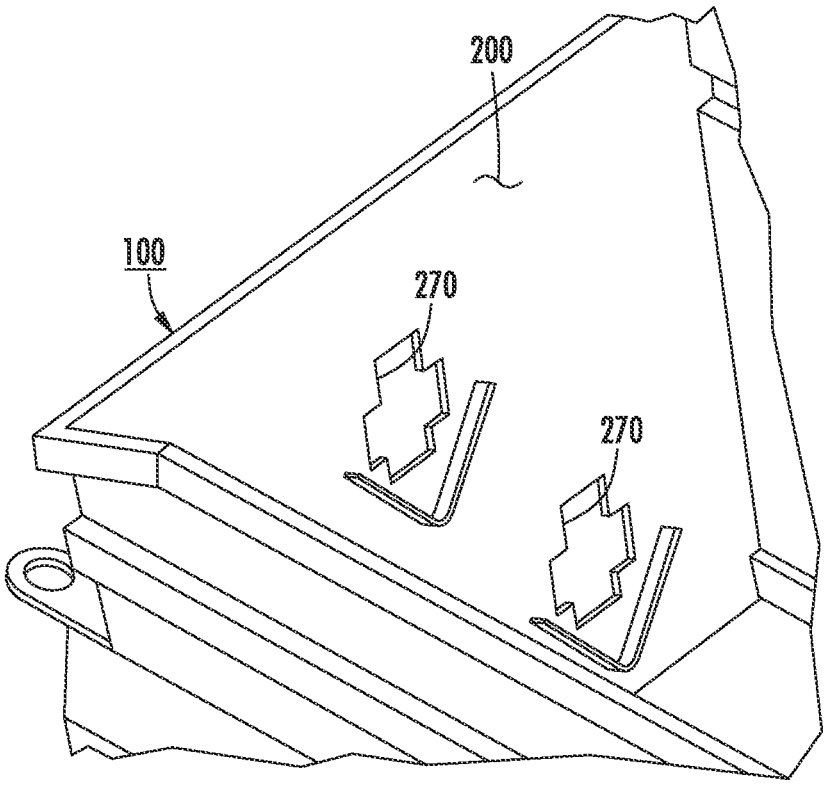
FIG. 11 is a perspective view of the front panel and the corrugated compaction ram.

FIG. 4 illustrates the first side 611 of the compaction ram 600. Unlike the corrugated shape of the second side 612 illustrated in FIG. 3, the first side 611 is essentially flat and planar without use of triangular beam 615 to aide rigidity. Spaced equidistantly apart from one another, a plurality of ram connectors 640 are fixed to the first side 611 of the front panel 610. More specifically, the front panel 610 includes a first ram connector 641, a second ram connector 642 and a corresponding third ram connector 643. These three ram connectors 640 are positioned along as to align with various passageways 270 (shown in FIG. 2 as well as FIG. 11).

FIG. 6 illustrates a side view of the compaction ram 600. As shown, the various ram connectors 640 can be spaced vertically apart from one another. This helps improve the stability of the compaction ram 640 while in use and prevent any twisting or rotation within the trash receptacle 100.

The Lock Assembly

Figure 2B:
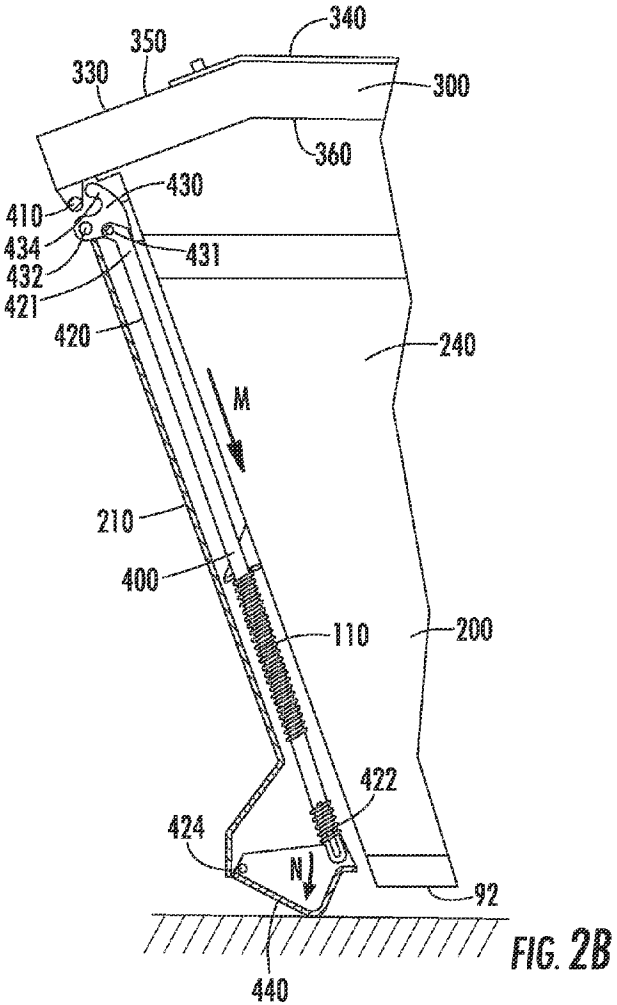
FIG. 2B is a right side view of the trash receptacle which includes the lock assembly in an open position.
Figure 2A:
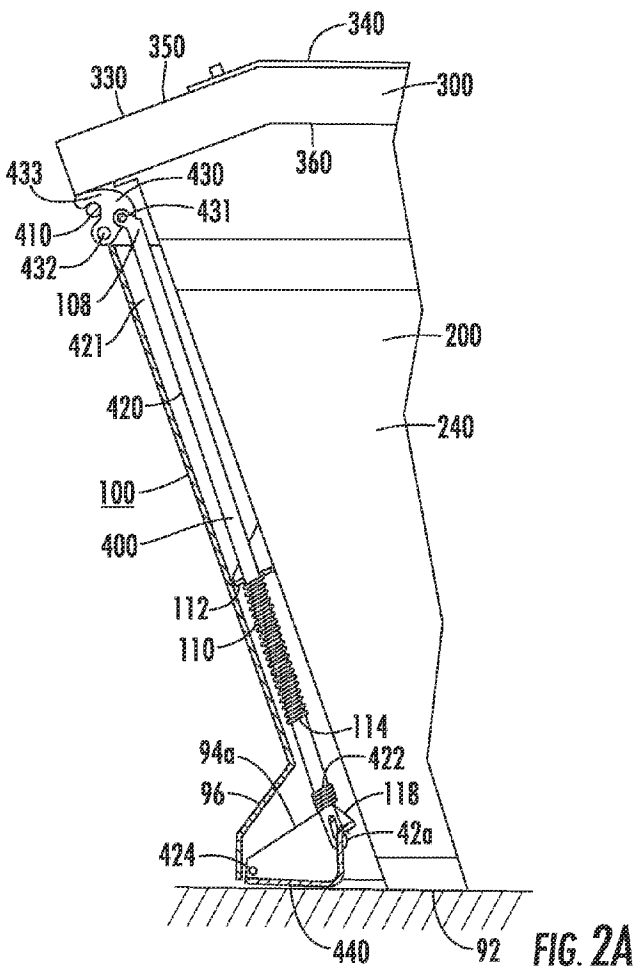
FIG. 2A is a right side view of the trash receptacle which includes a lock assembly in a closed position.

Both FIG. 2A and FIG. 2B illustrate, by way of example, one embodiment of the lock assembly 400. As previously discussed above, the lock assembly 400 helps both close and secure the top door 300 to the rigid outer housing 200. While such lock assembly 400 can engage more than one of the various panels 210-240 which comprise the rigid outer housing 200, both FIG. 2A and FIG. 2B illustrate application only on the front panel 210. However, those of ordinary skill in the art shall recognize similar systems which may include having locks located on the first side panel 230 and/or corresponding second side panel 240. Regardless, such lock assembly 400 functions to prevent entry of larger garbage which may degrade or damage the rigid outer housing 200.

FIG. 2A illustrates a side view of the lock assembly 100 showing both the second side wall 240 as well as the top door 300. As shown, the front door 300 includes a top surface 350 and corresponding bottom surface 360. Positioned proximate the front side 330 of the bottom surface 360 is a lock pin 410. Such lock pin 410 preferably runs along the length of the front side 330 of the front door 300.

Located along the front edge of the second side wall 240 is a pivot shaft 420. The pivot shaft 420 includes a first end 421 and a corresponding second end 422. Connected to the first end 421 of the pivot shaft 420 via a first pin 423 is a rotatable swivel lock 430. The rotatable swivel lock 430 includes a first pin hole 431, a second pin hole 432 and a finger lock 433 which forms a lock groove 434.

As further illustrated in FIG. 2B, the rotatable swivel lock 430 attaches to the first side wall 240 by connecting the second pin hole 432 to the second pin 424 which is affixed to the rigid outer housing 200. Correspondingly, the first pin 423 of the pivot shaft 420 connects with the first pin hole 431. Preferably, the pivot shaft 420 includes a spring 425. As further shown, when the rotatable swivel lock 430 pivots into position, it is of a sufficient size and orientation so as to engage and surround the lock pin 410. This occurs by having the finger lock 433 extend around the lock pin 410 which then fits within the lock groove 434.

A rotating foot 440 connects to the second end 422 of the pivot shaft 420 through a third pin 424. When the trash receptacle 100 is operating normally, the rotating foot 400 is flush with the ground or firmament as illustrated in FIG. 2A. When the basin 251 is squarely on the ground, this causes the pivot shat 420 to rise vertically, which in turn rotates the rotatable swivel lock 430 counter clockwise about the second pin 424 affixed to the rigid outer housing 200. This in turn causes the finger lock 433 to extend around the lock pin 410.

Turning back to FIG. 2B, when the trash receptacle 100 is being services, it is raised above the ground or firmament in order to dump compacted trash. By elevating the rigid outer housing 200, this causes the rotating foot 400 to swivel clockwise through rotation about the third pin 424. This in turn forces the pivot shaft 420 upwards, which then rotates the rotatable swivel lock 430 clockwise to release the lock pin 410. The end result is opening of the top door 300 to allow access to the compacted trash/garbage.

The Satellite Vehicle and Power Unit

FIGS. 6A through 6E illustrate, by way of example, one manner in which the trash receptacle 100 is engaged for purposes of compacting trash/garbage to reduce the number of visits of a larger commercial vehicle (in order to remove the trash). As shown, the invention contemplates use of a satellite vehicle 700 (shown in greater detail in both FIG. 8 and FIG. 9) which helps position a power unit 800 proximate the front panel 210 of the rigid outer housing 200. The power unit 800 can be either integral to the satellite vehicle 700 or can be a removable attachment. If removably attachable, such satellite vehicle 700 could be any form of commercially available truck or car—such as a pickup truck, van, car or related vehicle.

Regardless of whether the power unit 800 is integral or an attachment, such satellite vehicle 700 must be capable of driving to the location of each trash receptacle 100 as well as to properly position the power unit 800 to engage the compacting ram 600. Once such compacting ram 600 is engaged the overall volume of trash within the rigid outer housing 200 is reduced, allowing longer periods of time between servicing by larger and gas inefficient commercial vehicles.

Figure 6A:
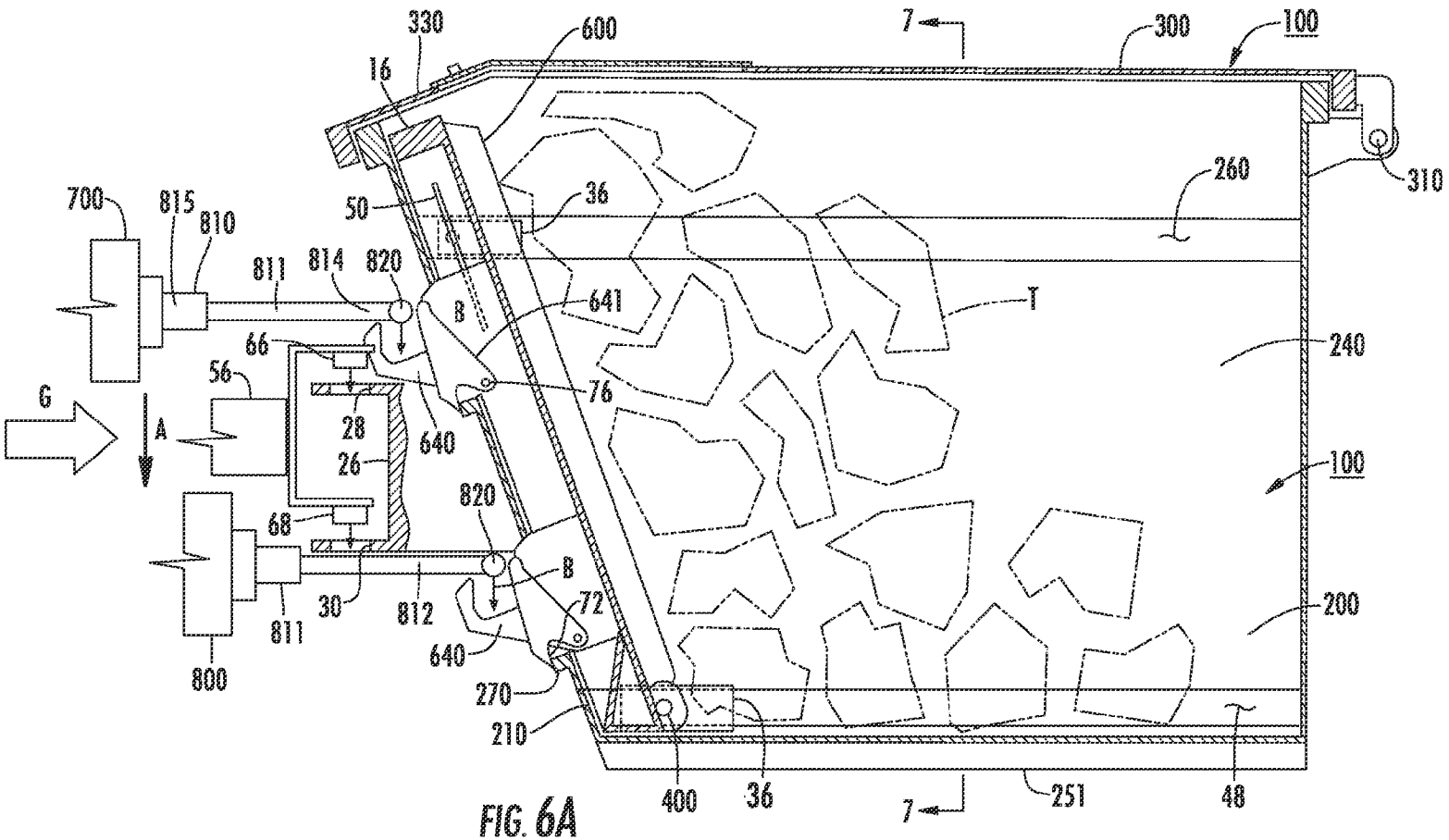
FIG. 6A is a cut away view of the trash receptacle showing the movable compaction ram prior to compression.
Figure 6B:
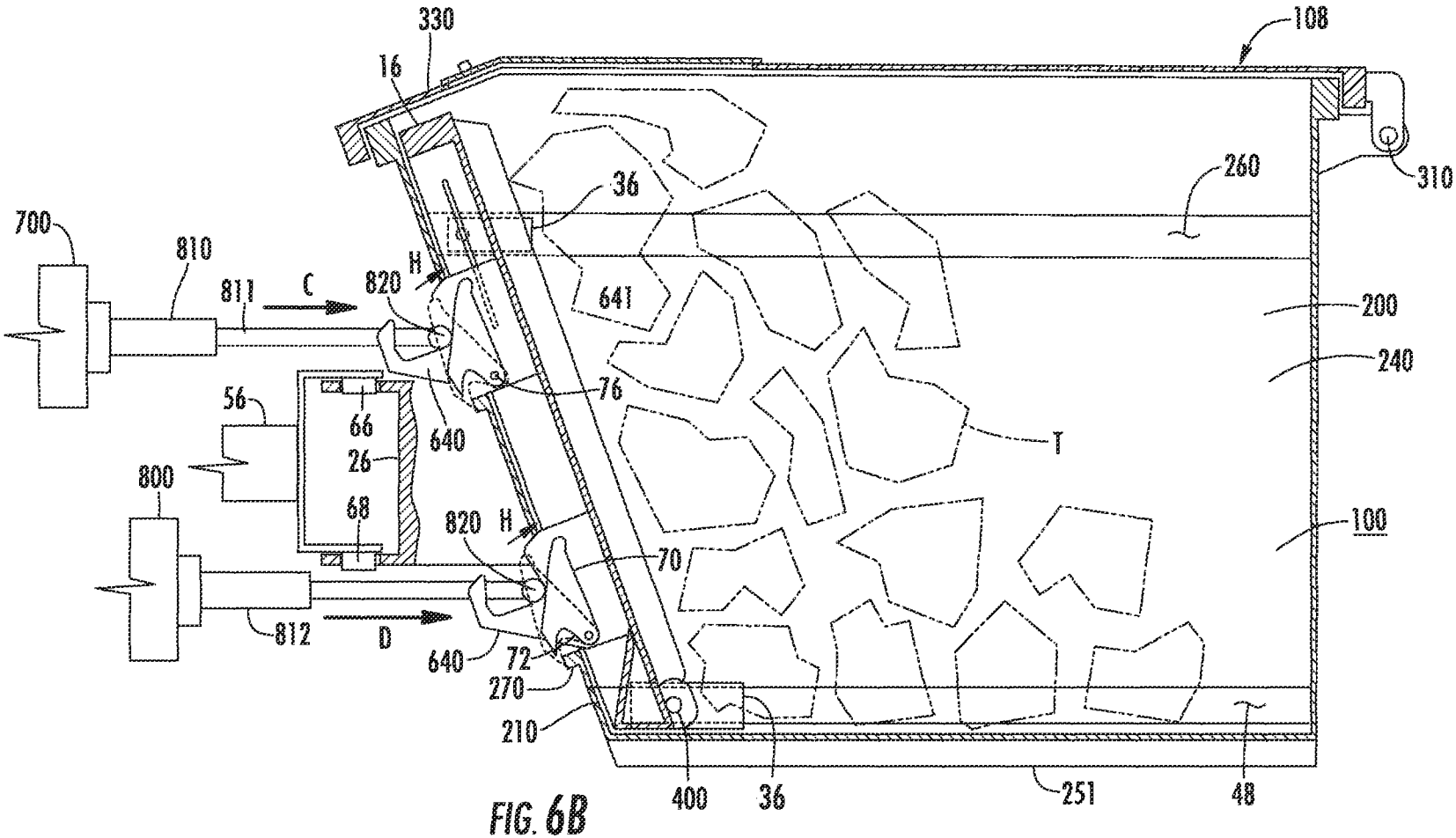
FIG. 6B is a cut away view of the trash receptacle showing engagement of the movable compaction ram by the drivable satellite vehicle and the power unit attached thereto.

FIG. 6A illustrates a portion of the power unit 800 in proximity with trash receptacle 100. More specifically, FIG. 6A shows the power unit 800 immediately prior to engagement with the ram connectors 640 positioned on the front of the compaction ram 600 (which exit the various passageways 270 positioned on the front panel 210 of the rigid outer housing 200). Such power unit 800 may include a plurality of horizontal connecting bars 810, as well as a plurality of engaging bars 850 (shown and illustrated in greater detail in FIGS. 8 and 9).

Preferably, there are three connecting bars 810: a first connecting bar 811, a second connecting bar 812 and a third connecting bar 813. More specifically, the first connecting bar 811 connects to the first ram connector 641, the second connector bar 812 connects to the second ram connector 642, and the third connecting bar 813 (not shown) connects with the third ram connector 643 (shown in FIG. 2).

Each of these connecting bars 810 includes a first end 814 and corresponding second end 815. As further shown in FIG. 6A, the first end 814 includes a contact bar 820. Such contact bar 820 is essentially perpendicular to the connecting bar 810 and of a sufficient size and dimension so as to engage the ram connector 640. Once each contact bar 820 engages a ram connector 640, such ram connector 640 pivots clockwise to lock the connector bar 813 in place while the power unit 800 forces the compression ram 600 into the rigid outer housing 200. This is shown and illustrated in FIG. 6B.

Figure 6C:
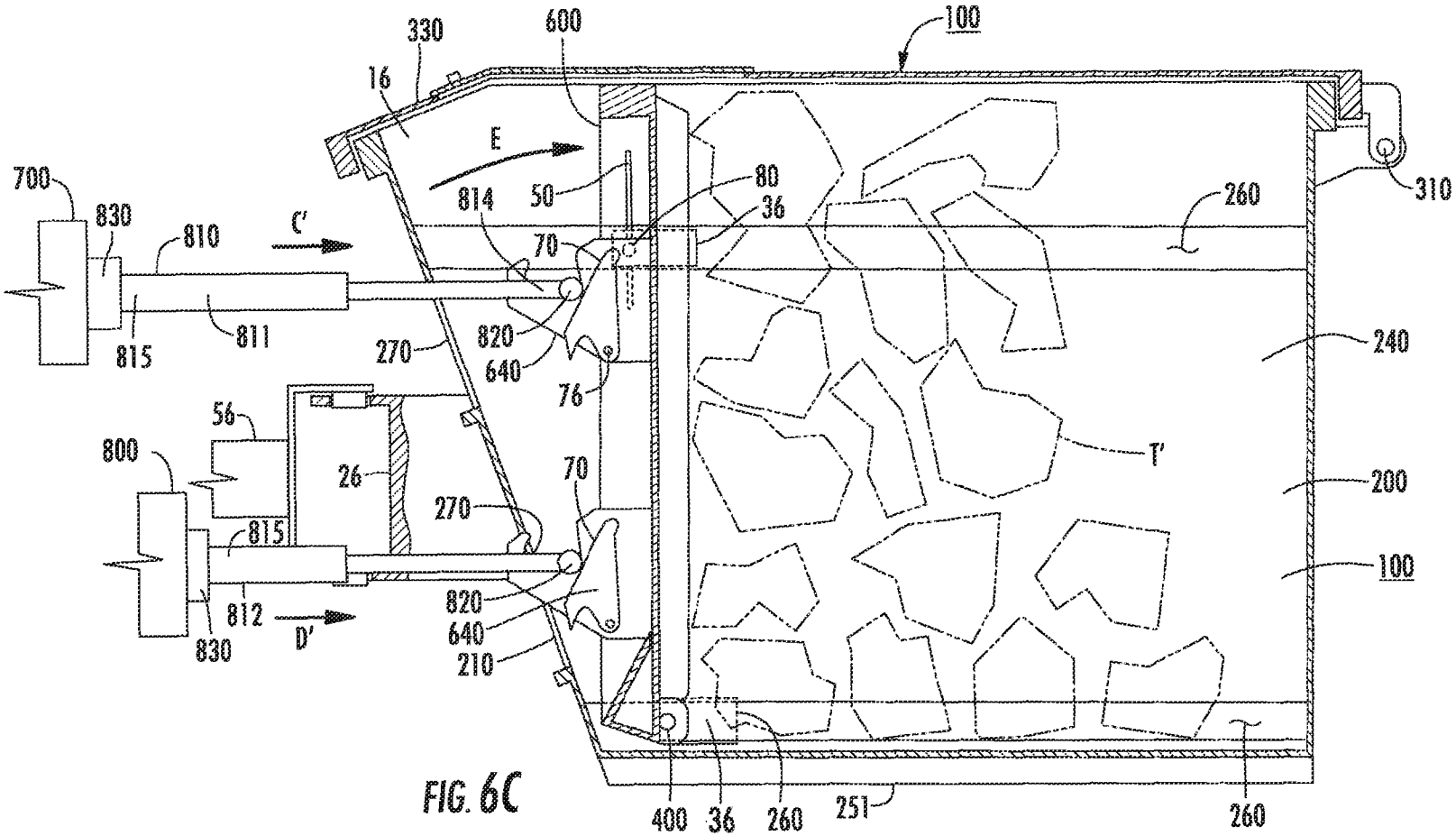
FIG. 6C is a cut away view of the trash receptacle showing the movable compaction ram starting compression.

FIG. 6C illustrates how the power unit 800 is able to position the compression ram 600 essentially parallel to the back panel 220 during engagement with the satellite vehicle 700. Such parallel arrangement helps maximize compression of the debris, trash and garbage located within the rigid outer housing 200. Such compaction is accomplished because actuators 830 are positioned at the second end 815 of each connecting bar 810 (as well as rigidly attached to the power unit 800). Such actuators 830 may take the structure of a hydraulic or pneumatic piston or any similar assembly known to those of ordinary skill in the art. Regardless, the actuators 830 function to push each connector bar 810 within the rigid outer housings, via passageways 270 located on the front panel 210, in order to force the compaction ram 600 onto the loosely laid trash/garbage.

Figure 6D:
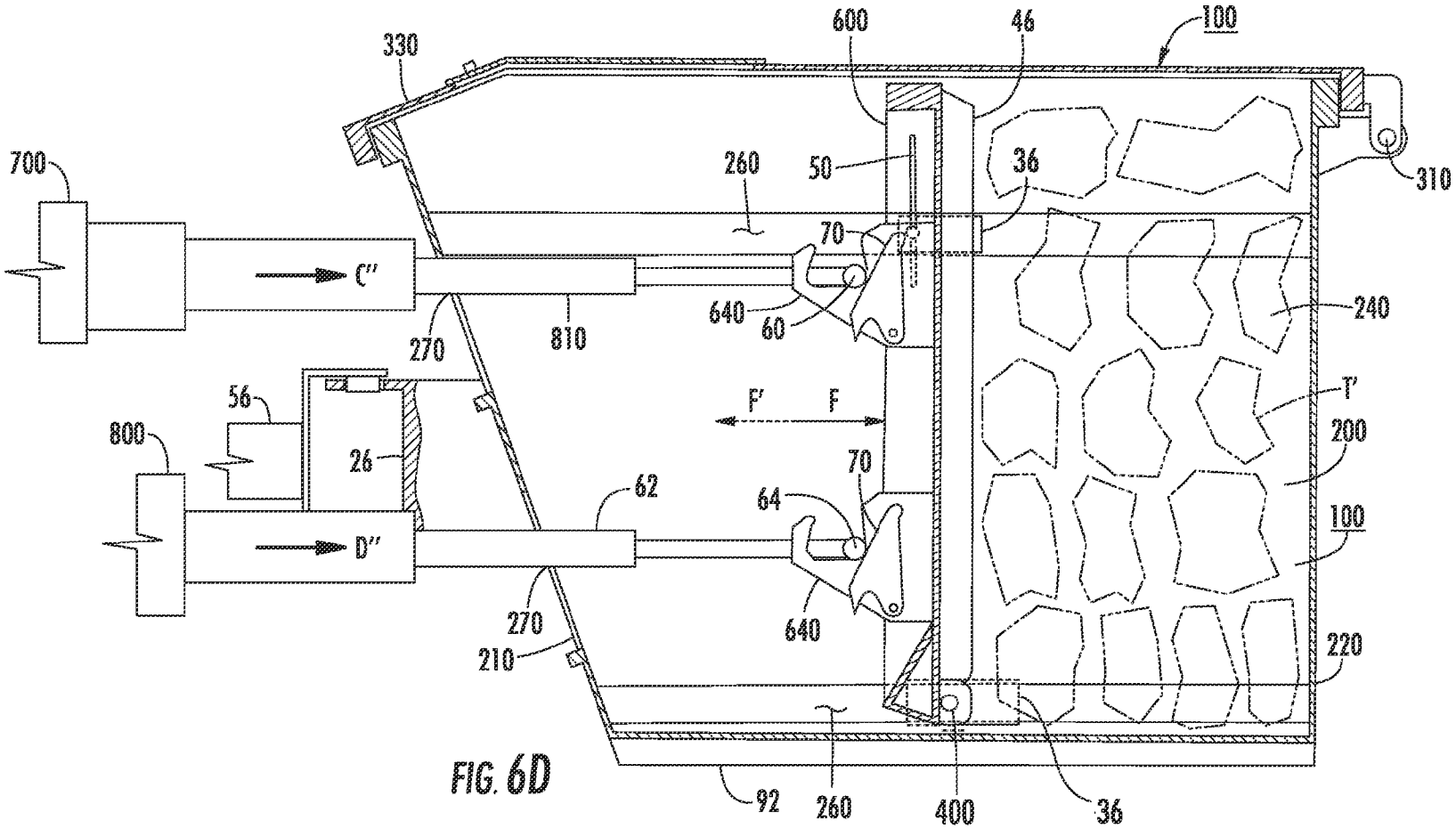
FIG. 6D is a cut away view of the trash receptacle showing the movable compaction ram half way through compression.

FIG. 6D illustrates the compaction ram 600 while it is roughly equidistant between the front panel 210 and back panel 220 of the rigid outer housing 200 during compaction of trash and garbage. As described in greater detail above, a series of track guides 36 (both top track guides and lower track guides) located on both the first side 611 and corresponding second side 612 of the compaction ram, which rest within tracks 260 positioned within the rigid outer housing 200. These tracks 260 help move the compaction ram 600.

Figure 6E:
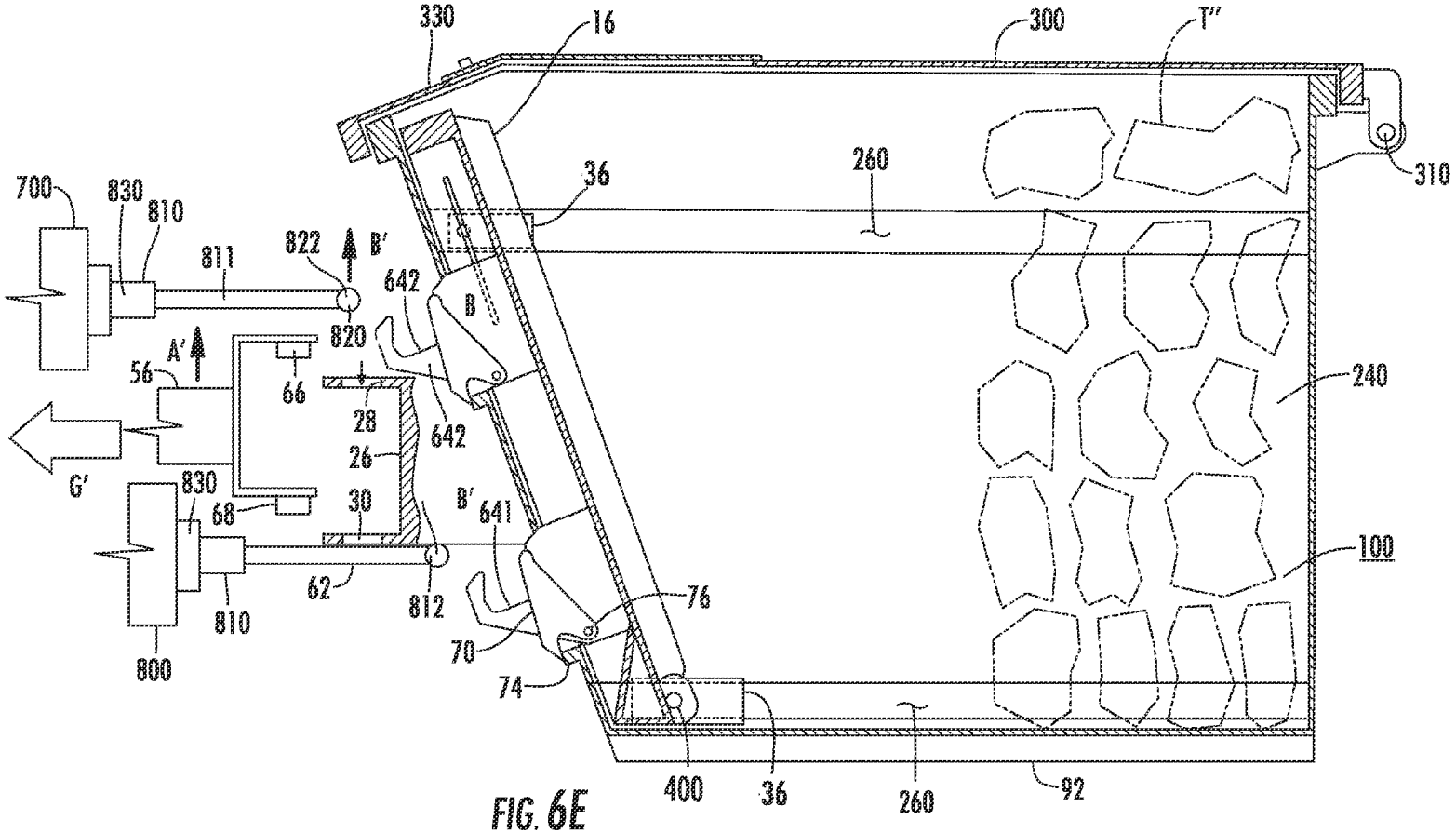
FIG. 6E is a cut away view of the trash receptacle showing the movable compaction ram returned to its stationary position after compression of trash.

FIG. 6E shows disengagement of each of the various connecting bars 810 from the ram connectors 640 subsequent to the compaction process. As shown, upon retrieval of the connecting bars 810, each ram connector 641-643 pivots counter clockwise hereby releasing each of the perpendicular contact bars 820. Once all of the contact bars 821-823 are released, the satellite vehicle 700 can slowly pull away from the trash receptacle 100. At this point, the compaction ram 600 can rest on the panel 210 of the rigid outer housing 200 as illustrated in FIG. 7.

Figure 8:
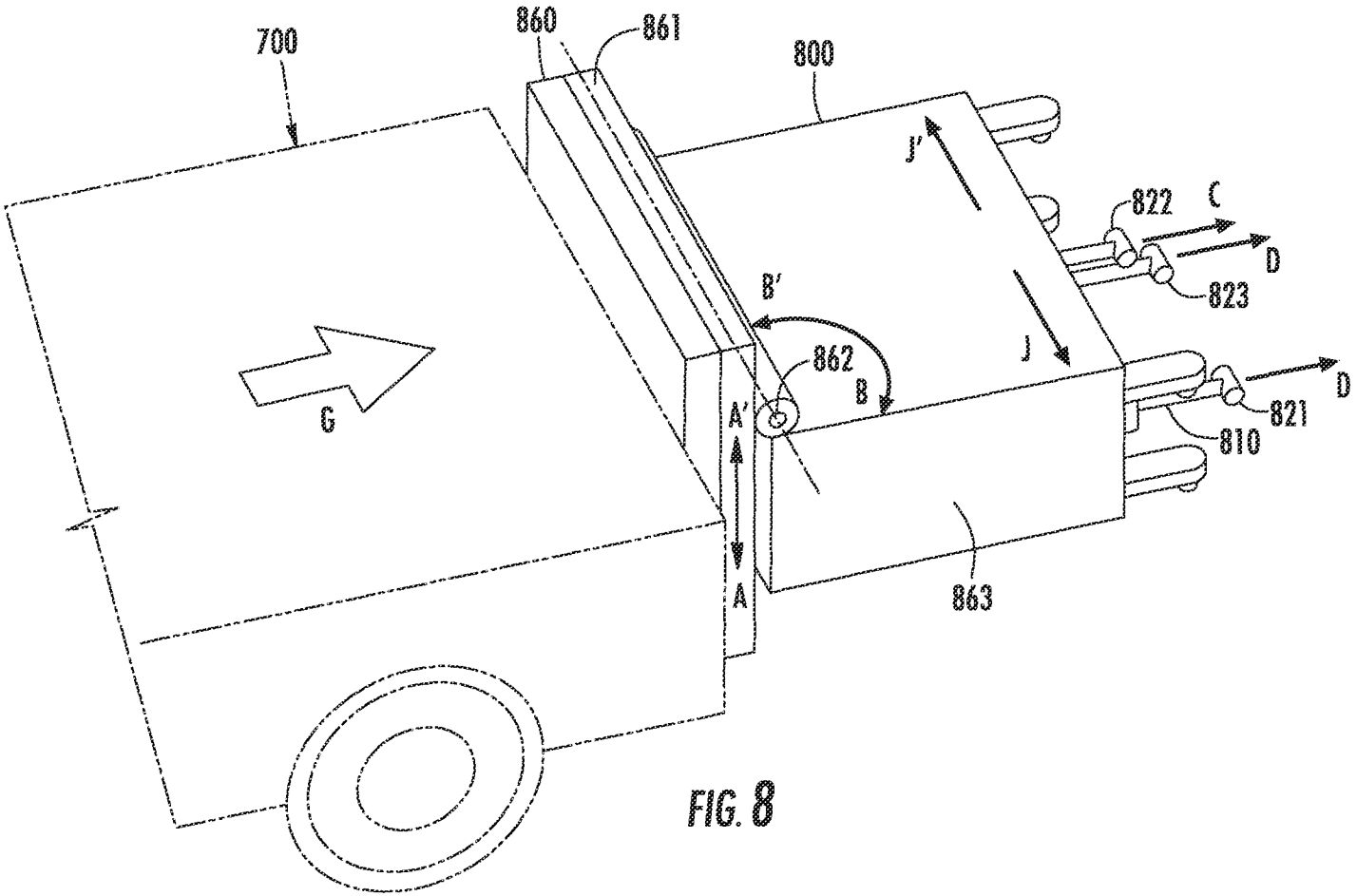
FIG. 8 is a first perspective view of the satellite vehicle and the power unit attached thereto.
Figure 9:
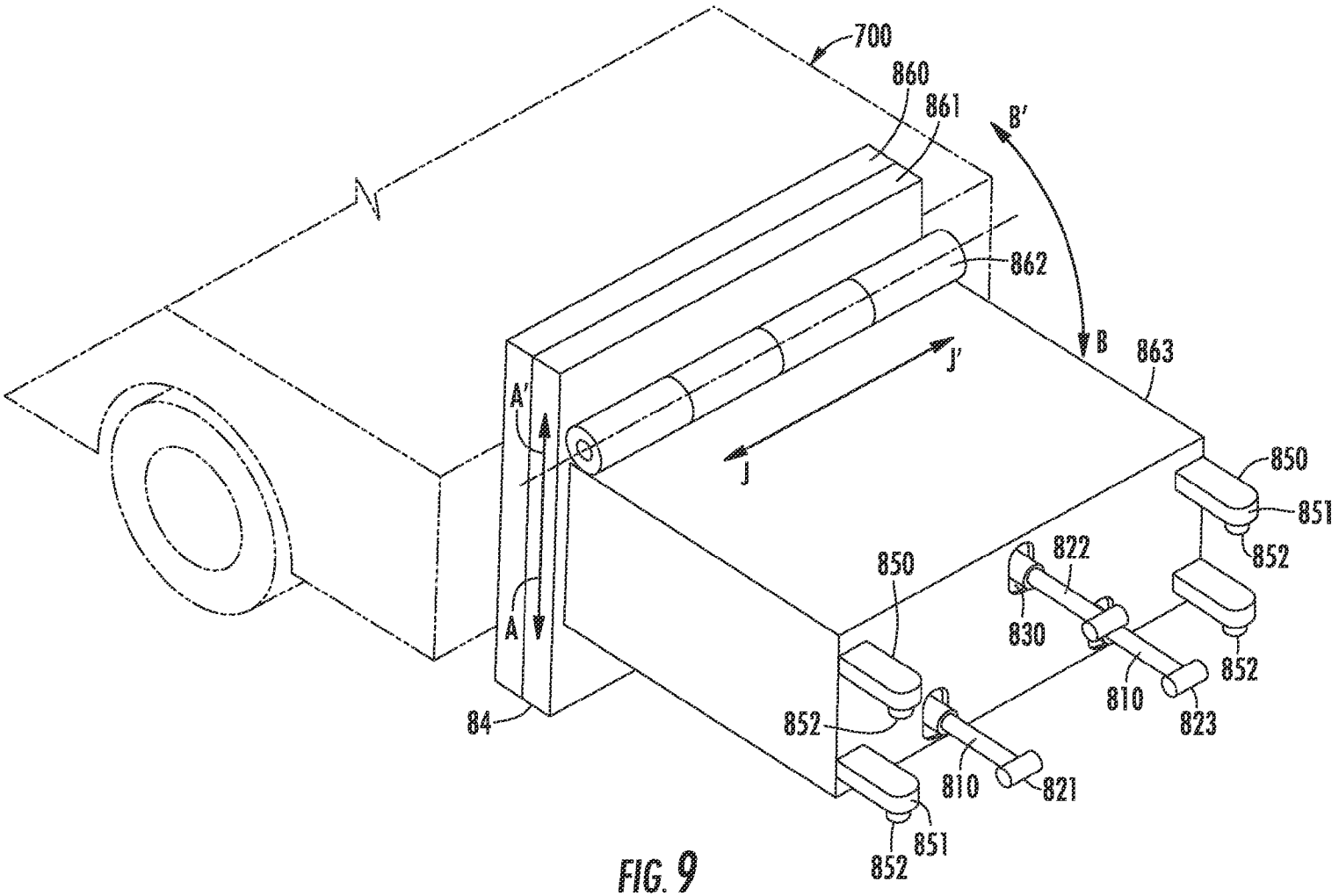
FIG. 9 is a second perspective view of the satellite vehicle and the power unit attached thereto.

Both FIG. 8 and FIG. 9 illustrate additional components 101 of the power unit 800. First turning to FIG. 8, the power unit 800 may attach to the satellite vehicle 700 via a mounting plate 860. This mounting plate 860 may include, by example, a vertical riser 861, a powered hinge 862 and a horizontal housing assembly 863. First, the vertical rise 861 functions to vertically move the housing assembly 863 (up and down) in relation to the height of the various ram connectors 641-643 (shown in FIGS. 6A through 6E). Such positioning and placement is further aided by the powered hinge 862 which helps pivot various connecting bars 810 positioned within the housing assembly 863 to engage the compaction ram 600.

Next turning to FIG. 9, the housing assembly 863 of the power unit may include three primary components 101: (a) a series of actuators 830 which may be powered pneumatically or hydraulically, (b) a plurality of connecting bars 811-813 wherein the second end 815 of each connecting bar 810 attaches to an actuator 830, and (c) a series of engaging bars 850 which can attach to one or more engaging members 500 (shown in FIG. 1 and FIG. 2) positioned on the rigid outer housing 200.

As shown in FIG. 1, both the first side panel 230 and corresponding second side panel 240 can include engaging members 500. The purpose and function of these engaging members 500 shown in FIG. 9 is to allow the engaging bars 850 to sufficiently connect the satellite vehicle 700 to the rigid outer housing 200. By doing so, this prevents slippage as the power unit 800 causes the actuators 830 to push the various connecting bars 810 into the various spaced actuator openings 211-213—in order to force compression ram 610 proximate the bottom panel 220 of the trash receptacle 100.

Figure 10A:
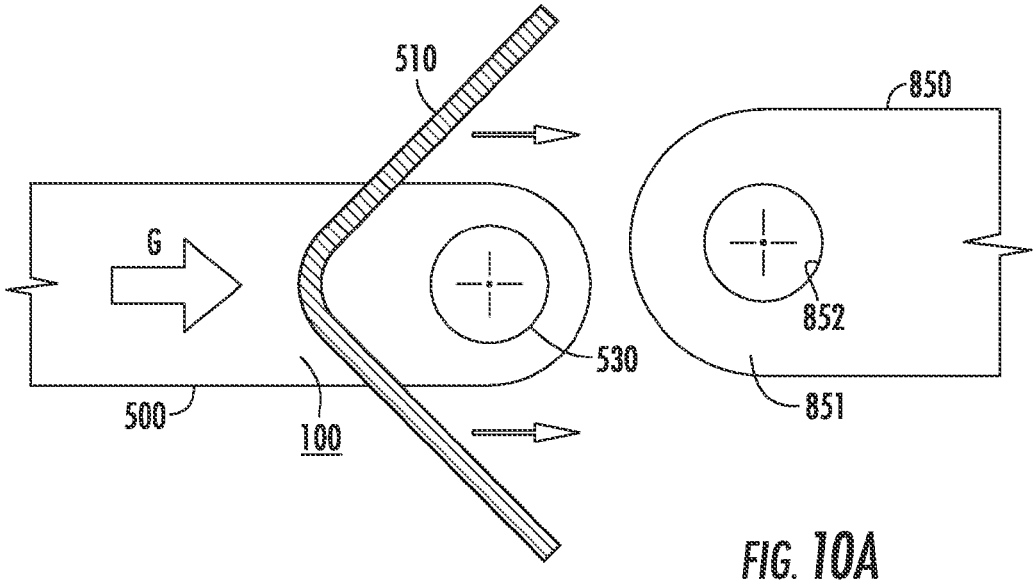
FIG. 10A is a first top view showing the engaging means connecting with the engaging bars of the power unit.
Figure 10B:
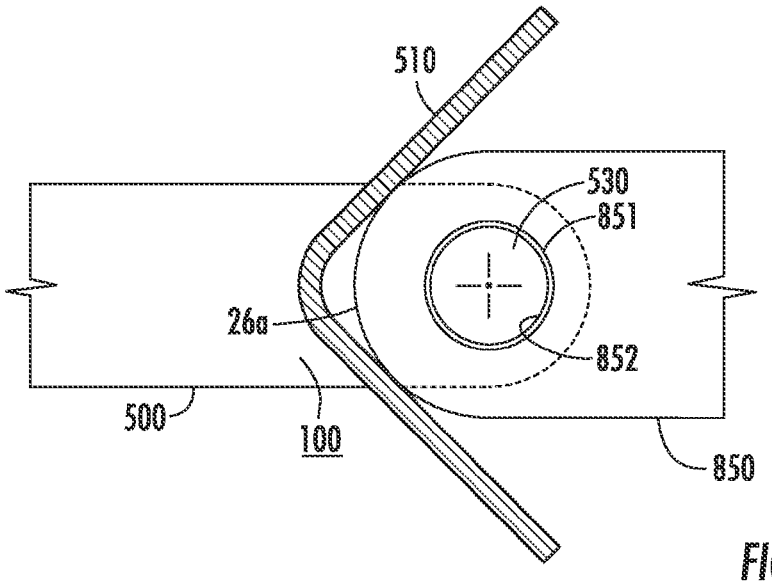
FIG. 10B is a second top view showing the engaging bar affixed to the engagement means via a cavity and knob.

Both FIG. 10A and FIG. 10B illustrate, by way of example, one structure for the engaging bars 850 to connect to an engaging member 500. First turning to FIG. 10A, each engaging member 500 may include a triangular guide 510, a curved distal tip 520 and a circular recess 530 positioned within the distal tip 520. Correspondingly, the end of the engaging bar 850 may include a curved distal end 851 having a knob 852 protruding from its bottom side. Such knob 852 may have a sufficient size and dimension so as to fit within the circular recess 530 located within the distal tip 520.

Next turning to FIG. 10B, such triangular guide 510 helps track the engaging bar 850 to affix to either the first side panel 230 or corresponding second side panel 240 of the rigid outer housing—when the satellite vehicle 700 is servicing the trash receptacle 100.

Method of Use

Apart from the apparatus describe above, the invention is further directed to a method of compacting trash through an advanced trash receptacle 100. The first step of the method is to position (shown and illustrated in FIG. 6A) one or more connecting bars 810 of a power unit 800 proximate one or more ram connectors 640 positioned on a compaction ram 600 located within a rigid outer housing 200. As shown in FIG. 1 and FIG. 2, such rigid outer housing includes a front panel 210, corresponding back panel 220, a first side panel 230 and a corresponding second side panel 240. Such front panel 210 includes one or more passageways 270 capable of allowing access to the one or more ram connectors 640.

The second step (shown in FIG. 6B) may include engaging the one or more connecting bars 810 with the one or more ram connectors 640 through use of contact bars 820 positioned at one end of each said connecting bar 810. Upon engaging such connecting bars 810, the third step (shown in FIG. 6C) is to move the compaction ram 600 toward the back panel of the rigid outer housing 200 through one or more track guides 36 in communication with one or more linear guides 260 positioned on the first side wall 230 and second side wall 240 of the rigid outer housing 200.

The fourth step (shown in FIG. 6D) of the method is to compact the trash positioned within the rigid outer housing 200 through contact between the back panel 220 and the compaction ram 600. Upon compaction, the fifth step (shown in FIG. 6E) is to return the compaction ram 600 to a position proximate the first panel 210 of the rigid outer housing 200 through use of one or more actuators positioned between the connecting bars 810 as the power unit 800. The final step is to disengage the one or more connecting bars 810 with the one or more ram connectors 640 and withdrawing the satellite vehicle 700, shown in FIG. 8 and FIG. 9.

An additional step contemplated by the invention is the step of shredding the trash positioned between the compaction ram 600 and the back panel 220 of the rigid outer housing 200 through placement of a plurality of triangular beams 615 such that each triangular beam 615 includes a sharp edge 616, shown and illustrated in FIG. 7.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

We claim:

1. A method of compacting trash, the method comprising the steps of:

providing a trash receptacle comprising a rigid outer housing with a compaction ram located therein, the rigid outer housing having a front panel, a corresponding back panel, a first side panel and a corresponding second side panel, the front panel is configured to slope generally outward relative to the back panel, the front panel including one or more passageways capable of allowing access to one or more ram connectors positioned on the compaction ram, the first and second side panels each having one or more linear guides, the trash receptacle including a top cover having a hinged connection to the back panel, wherein the hinged connection is downstream the compaction ram and opposing engaging members on each outside surface of the first and second side panels, wherein the compaction ram is moveable between the engaging members along inside surfaces of the first and second side panels;

driving a satellite vehicle containing a power unit proximal the front panel, the power unit comprising a plurality of connecting bars, each connecting bar comprising a first end and a second end, wherein each connecting bar is operable with an actuator at its second end;

removably engaging the first end of each of the connecting bars with the one or more ram connectors through the one or more passageways of the front panel;

aligning the compaction ram from an inclined position generally parallel with an angled inner surface of the front panel to a vertical position parallel to the back panel through movement of the one or more ram connectors;

actuating the compaction ram for movement toward the back panel of the rigid outer housing through one or more track guides in communication with the one or more linear guides positioned on the first and second side panels, wherein the compactor ram is moveable fully along the bottom panel to the back panel restricted only by the trash being compacted thereby;

compacting trash positioned within the rigid outer housing through contact between the back panel and the compaction ram;

actuating the compaction ram for a return movement to a position proximate the front panel of the rigid outer housing; and disengaging each of the plurality of connecting bars with the one or more ram connectors and driving the satellite vehicle away from the trash receptacle.

2. The method claim 1, wherein the front panel, the back panel, the first side panel and the second side panel of the rigid outer housing are each connected to a bottom panel to form a basin.

3. The method of claim 2, wherein the first side panel and the second side panel are essentially parallel to one another.

4. The method of claim 1, wherein the top cover includes a front side having one or more access doors to allow placement of garbage within the rigid outer housing therethrough.

5. The method of claim 1, further comprising positioning the trash receptacle on a support surface for frictionally affixing thereto.

6. The method of claim 5, further comprising locking the top cover to the front panel for preventing hinging of the top cover, wherein the locking is actuated by the positioning of the trash receptacle onto the support surface.

7. The method of claim 6, further comprising unlocking the top cover by lifting the trash receptacle by the engaging members.

8. The method according to claim 1, wherein the removably engaging of the first end of each of the connecting bars with the one or more ram connectors through the one or more passageways of the front panel comprises:

connecting a first connecting bar to a first ram connector;

connecting a second connecting bar to a second ram connector;

connecting a third connecting bar to a third ram connector; and pivoting the ram connectors for a locking to the connecting bars.

9. The method according to claim 8, wherein the compaction ram parallel aligning comprises the actuating of each of the connecting bars for movement thereto.

* * * * *